US009735480B2

(12) United States Patent
Harwath

(10) Patent No.: US 9,735,480 B2
(45) Date of Patent: Aug. 15, 2017

(54) COAXIAL CABLE AND CONNECTOR ASSEMBLY

(71) Applicant: CommScope Technologies LLC, Hickory, NC (US)

(72) Inventor: Frank A. Harwath, Naperville, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/851,495

(22) Filed: Sep. 11, 2015

(65) Prior Publication Data

US 2016/0079688 A1 Mar. 17, 2016

Related U.S. Application Data

(60) Provisional application No. 62/049,160, filed on Sep. 11, 2014.

(51) Int. Cl.
*H01R 9/05* (2006.01)
*H01R 4/26* (2006.01)

(52) U.S. Cl.
CPC ..... *H01R 9/05* (2013.01); *H01R 4/26* (2013.01); *H01R 9/0518* (2013.01)

(58) Field of Classification Search
CPC .. H01R 4/5033; H01R 4/2475; H01R 4/2483; H01R 4/2487; H01R 9/0524; H01R 24/38; H01R 9/05; H01R 9/0518
USPC ..... 439/427–429, 578, 583–585
See application file for complete search history.

(56) References Cited

U.S. PATENT DOCUMENTS 3,245,027 A * 4/1966 Ziegler, Jr. ..... H01R 9/0518 174/88 C
6,350,146 B1 * 2/2002 Su ..... H01R 4/5033 439/427
8,083,539 B2 * 12/2011 Suzuki ..... H01R 4/5033 439/264

(Continued)

FOREIGN PATENT DOCUMENTS

KR 10-2011-0125922 11/2011

OTHER PUBLICATIONS

International Search Report and Written Opinion for corresponding PCT Application No. PCT/US2015/049355, date of mailing Dec. 22, 2015, 16 pages.

*Primary Examiner* — Abdullah Riyami
*Assistant Examiner* — Thang Nguyen
(74) *Attorney, Agent, or Firm* — Myers Bigel, P.A.

(57) ABSTRACT

A coaxial cable-connector assembly includes a coaxial cable and a coaxial connector. The coaxial cable includes: an inner conductor having a termination end, the termination end including a bore; a dielectric layer that overlies the inner conductor; an outer conductor that overlies the dielectric layer having a termination end; and a jacket that overlies the outer conductor. The coaxial connector includes: an inner conductor body including a boss that encircles the termination end of the inner conductor and a longitudinal bore; an outer conductor body electrically connected with the termination end of the outer conductor; and an expansion member inserted into the bore of the termination end of the inner conductor, the expansion member being sized and configured to radially expand the termination end of the inner conductor into electrical contact with the boss of the inner conductor body.

12 Claims, 3 Drawing Sheets

(56) References Cited

U.S. PATENT DOCUMENTS

| | | | | |
|---|---|---|---|---|
| 8,137,125 | B2 * | 3/2012 | Takehara | H01R 4/5033 174/94 S |
| 2003/0207610 | A1 * | 11/2003 | Lindemann | H01R 4/5033 439/427 |
| 2007/0117447 | A1 * | 5/2007 | Hanks | H01R 4/5033 439/427 |
| 2008/0139045 | A1 * | 6/2008 | Ho | H01R 13/622 439/578 |
| 2008/0233791 | A1 * | 9/2008 | Hanks | H01R 4/5033 439/427 |
| 2009/0215306 | A1 * | 8/2009 | Hanks | H01R 4/5033 439/427 |
| 2012/0064768 | A1 | 3/2012 | Islam et al. | |
| 2012/0088404 | A1 * | 4/2012 | Wild | H01R 24/564 439/584 |
| 2012/0129391 | A1 | 5/2012 | Van Swearingen et al. | |
| 2013/0034983 | A1 | 2/2013 | Purdy et al. | |
| 2013/0143439 | A1 * | 6/2013 | Nugent | H01R 9/0518 439/585 |
| 2015/0118898 | A1 * | 4/2015 | Paynter | H01R 9/0503 333/24 C |

* cited by examiner

COAXIAL CABLE AND CONNECTOR ASSEMBLY

RELATED APPLICATION

The present application claims priority from and the benefit of U.S. Provisional Patent Application No. 62/049,160, filed Sep. 11, 2014, the disclosure of which is hereby incorporated herein in its entirety.

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector having a particular connector interface and (b) a corresponding connector with a mating connector interface mounted on an apparatus (such as an antenna or remote radio head) or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector that fits within or over the outer conductor body of the first connector. Coaxial connector interfaces often utilize a threaded coupling nut or other retainer that draws the connector interface pair into secure electro-mechanical engagement when the coupling nut (which is captured by one of the connectors) is threaded onto the other connector.

Passive Intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire RF system. Thus, the reduction of PIM via connector design is typically desirable.

It may be desirable to provide alternative techniques for attaching connectors to cable conductors that enjoy low PIM and relatively low labor manufacturing.

SUMMARY

As a first aspect, embodiments of the invention are directed to a coaxial cable-connector assembly. The assembly comprises a coaxial cable and a coaxial connector. The coaxial cable comprises: an inner conductor having a termination end, the termination end including a bore; a dielectric layer that overlies the inner conductor; an outer conductor that overlies the dielectric layer having a termination end; and a jacket that overlies the outer conductor. The coaxial connector comprises: an inner conductor body configured to mate with the inner conductor body of a mating coaxial cable jack, the inner conductor body including a boss that encircles the termination end of the inner conductor, and further including a longitudinal bore; an outer conductor body configured to mate with the outer conductor body of the mating coaxial cable jack, the outer conductor body being electrically connected with the termination end of the outer conductor; and an expansion member inserted into the bore of the termination end of the inner conductor, the expansion member being sized and configured to radially expand the termination end of the inner conductor into electrical contact with the boss of the inner conductor body.

As a second aspect, embodiments of the invention are directed to a coaxial connector comprising: an inner conductor body configured to mate with the inner conductor body of a mating coaxial cable jack, the inner conductor body further configured to be attached to a termination end of an inner conductor of a coaxial cable; and an outer conductor body configured to mate with the outer conductor body of the mating coaxial cable jack, the outer conductor body further configured to be electrically connected with a termination end of an outer conductor of the coaxial cable. The outer conductor body further includes a radially inward lip, such that a gap is formed between the lip and an inner surface of the outer conductor body, and is configured to receive the termination end of the outer conductor of the cable resides within the gap. The outer conductor body is configured to be crimped to the termination end of the outer conductor of the cable.

As a third aspect, embodiments of the invention are directed to a coaxial cable-connector assembly, comprising a coaxial cable and a coaxial connector. The coaxial cable comprises: an inner conductor having a termination end; a dielectric layer that overlies the inner conductor; an outer conductor that overlies the dielectric layer having a termination end; and a jacket that overlies the outer conductor. The coaxial connector comprises: an inner conductor body configured to mate with the inner conductor extension of a mating coaxial cable jack, the inner conductor body attached to the termination end of the inner conductor; and an outer conductor body configured to mate with the outer conductor extension of the mating coaxial cable jack, the outer conductor body being electrically connected with the termination end of the outer conductor. The outer conductor body is crimped to the termination end of the outer conductor of the cable and is also crimped over the jacket.

As a fourth aspect, embodiments of the invention are directed to a method of forming a coaxial cable-connector assembly, comprising the steps of: (a) providing a coaxial cable comprising: an inner conductor having a termination end, the termination end including a bore; a dielectric layer that overlies the inner conductor; and an outer conductor that overlies the dielectric layer having a termination end; (b) providing a coaxial connector comprising: an inner conductor body configured to mate with the inner conductor body of a mating coaxial cable jack, the inner conductor body including a boss that encircles the termination end of the inner conductor, and further including a longitudinal bore; and an outer conductor body configured to mate with the outer conductor body of the mating coaxial cable jack, the outer conductor body being electrically connected with the termination end of the outer conductor; and (c) inserting an expansion member into the bore of the termination end of the inner conductor, the expansion member being sized and configured to radially expand the termination end of the inner conductor into electrical contact with the boss of the inner conductor body.

As a fifth aspect, embodiments of the invention are directed to a method of forming a coaxial cable-connector assembly, comprising the steps of: (a) providing a coaxial cable comprising: an inner conductor having a termination end; a dielectric layer that overlies the inner conductor; an outer conductor that overlies the dielectric layer having a termination end; and a jacket that overlies the outer conductor; (b) providing a coaxial connector comprising: an inner conductor body configured to mate with the inner conductor extension of a mating coaxial cable jack, the inner conductor body attached to the termination end of the inner conductor; and an outer conductor body configured to mate with the outer conductor extension of the mating coaxial cable jack, the outer conductor body being electrically connected with the termination end of the outer conductor; (c) crimping the outer conductor body to the termination end of the outer conductor of the cable and (d) crimping the outer conductor body over the jacket.

As a sixth aspect, embodiments of the invention are directed to a cable-connector assembly, comprising a cable and a connector. The cable comprises a conductor having a termination end, the termination end including a bore. The connector comprises a conductor body configured to mate with a conductor body of a mating connector. An expansion member is inserted into the bore of the termination end of the conductor, the expansion member being sized and configured to radially expand the termination end of the conductor into electrical contact with the conductor body.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
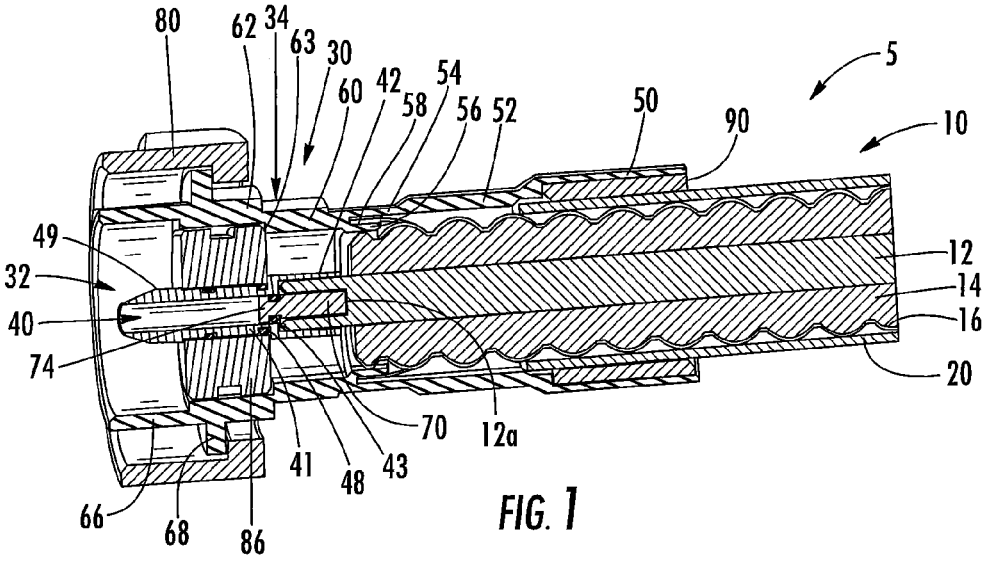
FIG. 1 is a perspective section view of a cable-connector assembly according to embodiments of the present invention.

Referring now to the drawings, a connector-cable assembly, designated broadly at 5, is shown in FIG. 1. The assembly 5 comprises a coaxial cable 10 and a plug 30, each of which is described in detail below.

Figure 6:
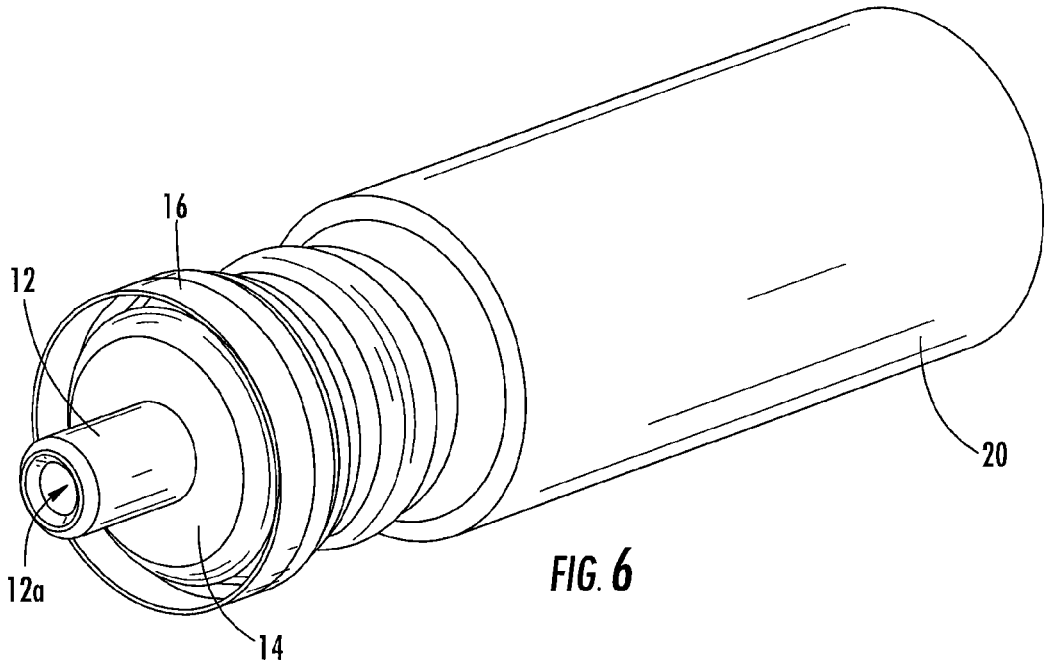
FIG. 6 is a perspective view of the connector end of the inner conductor and outer conductors of the cable of the assembly of FIG. 1.

Referring to FIGS. 1 and 6, the coaxial cable 10 includes an inner conductor 12, a dielectric layer 14 that circumferentially overlies the central conductor 12, an outer conductor 16 that circumferentially overlies the dielectric layer 14, and a polymeric cable jacket 20 that circumferentially overlies the outer conductor 16. These components will be well-known to those of skill in this art and need not be described in detail herein. Notably, the inner conductor 12 includes a bore 12*a* (best seen in FIG. 6) at its terminal end. FIGS. 1 and 6 illustrate that the outer conductor 16 may be of a corrugated profile; alternatively, the outer conductor 16 may have a smooth, braided or foil profile. All of these outer conductor configurations are known to those of skill in this art and need not be described in detail herein.

Figure 4:
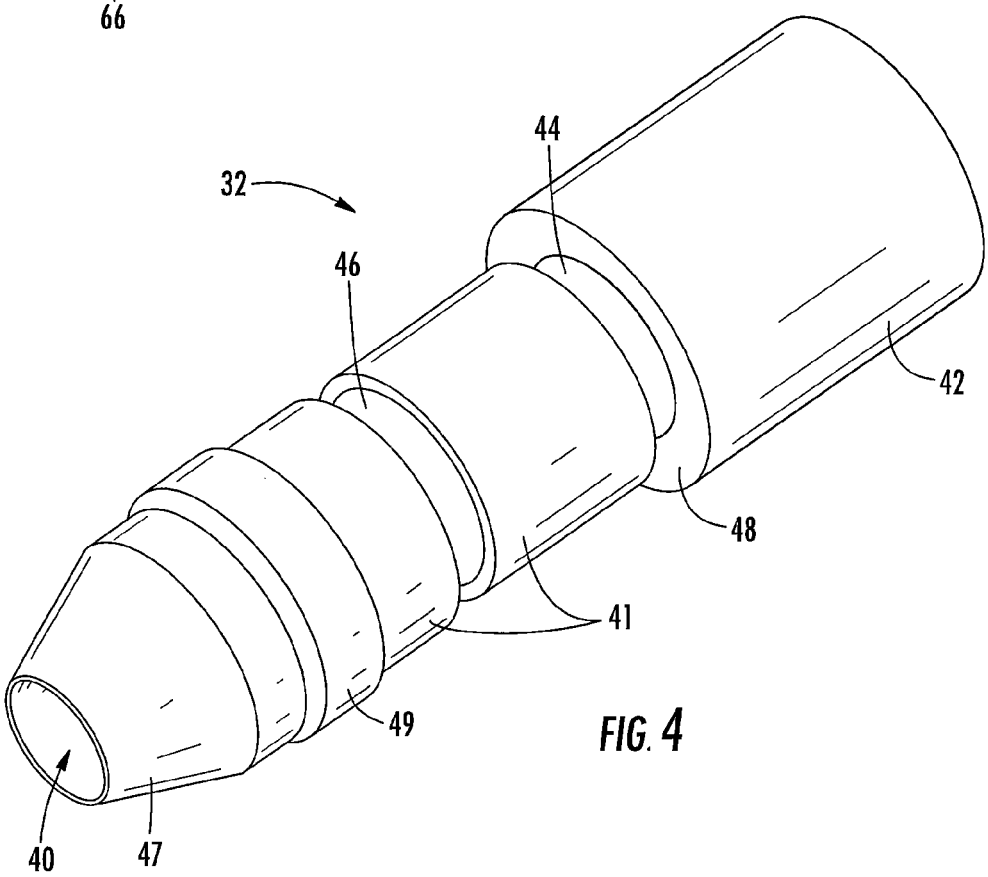
FIG. 4 is a perspective view of the inner conductor body of the assembly of FIG. 1.

Referring to FIGS. 1 and 4, the plug 30 includes an inner conductor body 32 and an outer conductor body 34. As can be seen in FIGS. 1 and 4, the inner conductor body 32 is generally cylindrical and comprises a sleeve 41 that includes a central bore 40 extending longitudinally therethrough. A boss 42 extends from one end of the sleeve 41; the boss 42 has an inner diameter that is larger than that of the bore 40, thereby creating a shoulder 43 (see FIG. 1), and has an outer diameter that is larger than that of the sleeve 41, thereby creating a shoulder 48. Two annular grooves 44, 46 are present in the outer surface of the sleeve 41, with the groove 44 forming part of the shoulder 48. A ridge 49 extends radially outwardly from the sleeve 41 near the chamfered tip 47. The inner conductor body 32 is configured to mate with the inner conductor body of a mating jack.

Figure 2:
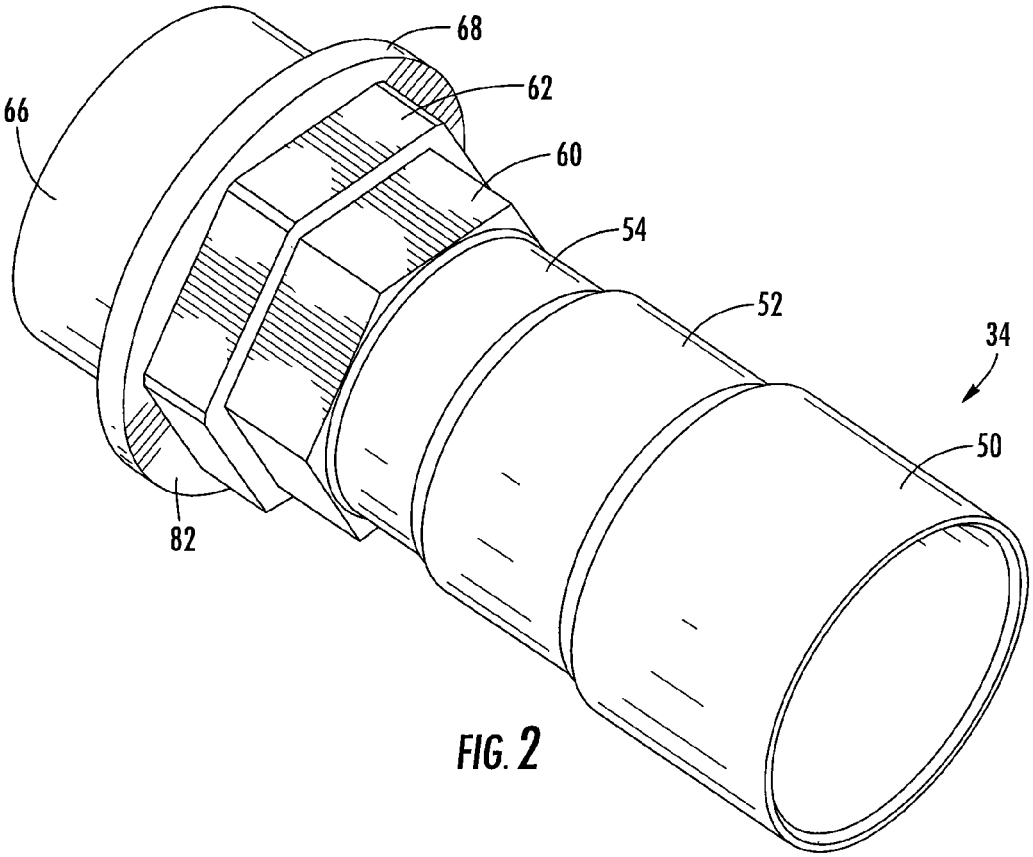
FIG. 2 is a perspective view of the outer conductor body of the assembly of FIG. 1.
Figure 3:
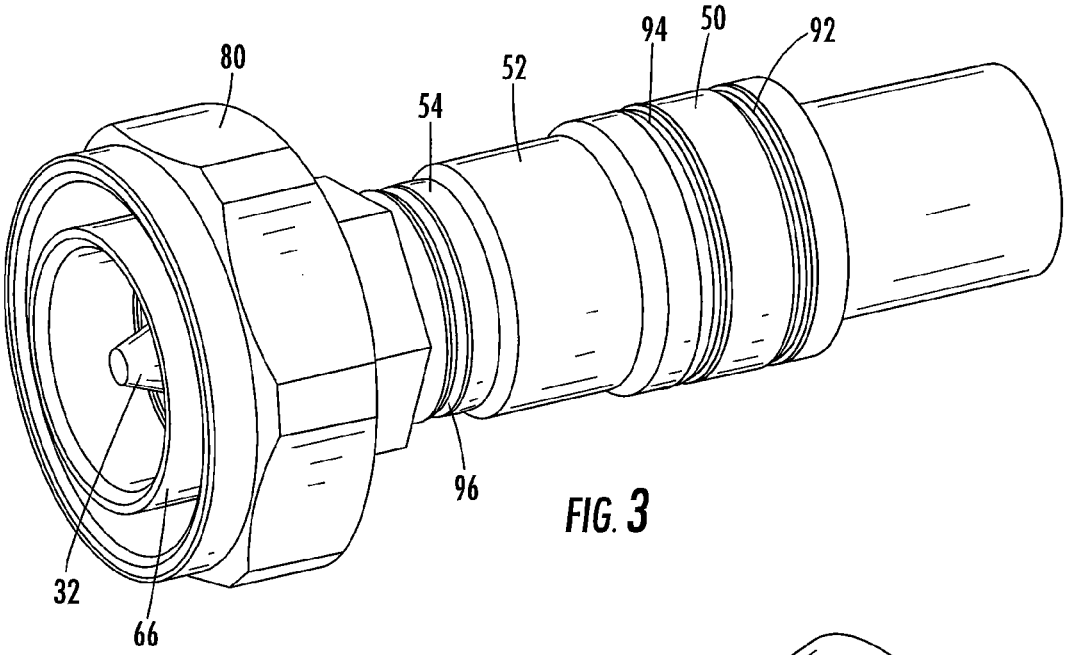
FIG. 3 is a perspective view of the assembly of FIG. 1 with the outer conductor body crimped into place.

Referring now to FIGS. 1-3, the outer conductor body 34 is generally cylindrical and comprises multiple merging sections. A jacket crimping section 50 is present at one end, with a slightly smaller transition section 52 merging therewith. A slightly smaller conductor crimping section 54 merges with the transition section 52. A lip 56 is positioned radially inward of the conductor crimping section 54 and creates a gap 58 that is open in the direction of the jacket crimping section 50. A first hexagonal section 60 merges with the conductor crimping section 54, and a second, slightly larger hexagonal section 62 merges with the first hexagonal section 60; a shoulder 63 is created by the offset in the inner surfaces of the hexagonal sections 60, 62. A mating section 66 configured to mate with a mating jack merges with the second hexagonal section 62. A ring 68 extends radially outwardly from the mating section 66 and provides a bearing surface 82 for interaction with a coupling nut 80.

Figure 5:
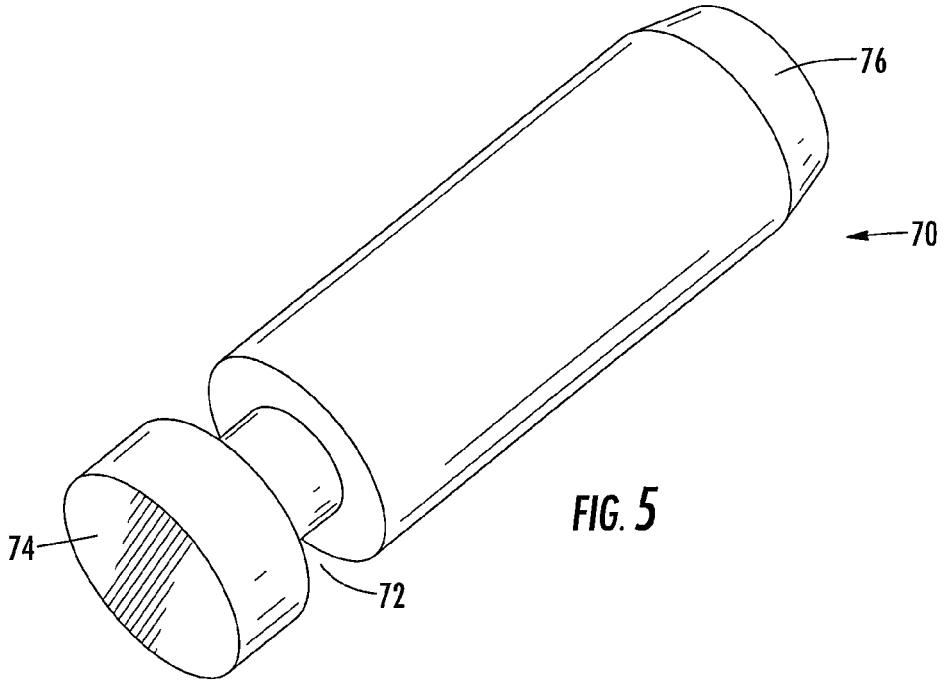
FIG. 5 is a perspective view of the dowel of the assembly of FIG. 1.

Referring now to FIGS. 1 and 5, a generally cylindrical dowel 70 includes a recess 72. The presence of the recess 72 forms a knob 74 at one end of the dowel 70. End 76 of the dowel 70 opposite the knob 74 is chamfered. FIG. 1 also illustrates a dielectric spacer 86 that separates the sleeve 41 of the inner conductor body 32 from the outer conductor body 34.

FIG. 1 illustrates the assembled plug 30 and cable 10. The jacket crimping section 50 of the outer conductor body 34 fits over the jacket 20 of the cable 10, with an optional sealing ring 90 (typically formed of a resilient material such as rubber or another elastomer) interposed between the jacket crimping section 50 and the jacket 20. The termination end of the outer conductor 16, which is flared outwardly to allow it to expand in diameter, fits within the gap 58 between the conductor crimping section 54 and the lip 56, with the lip 56 potentially serving as a stop for the termination end of the outer conductor 16. The boss 42 of the inner conductor body 32 fits over the outer surface of the inner conductor 12, such that the bore 12*a* aligns with the bore 40; the end of the inner conductor 12 may abut the shoulder 48 of the inner conductor body 32.

As can be seen in FIG. 3, the outer conductor body 34 is secured to both the cable jacket 20 and the outer conductor 16 via crimping. FIG. 3 shows two grooves 92, 94 in the jacket crimping section 50 of the outer conductor body 34 formed by a crimping operation that forces the jacket crimping section 50 onto the jacket 20. This crimping is intended to produce a watertight seal, and can also create a mechanical fulcrum where relative movement of the cable is not easily transmitted directly to either the outer or inner conductor interfaces. This can reduce the probability that the interfaces will experience relative motion, which can contribute to unacceptable levels of PIM.

FIG. 3 also illustrates a groove 96 formed in the conductor crimping section 54 formed by a crimping operation (which may be simultaneous with the crimping of the jacket crimping section 50); the crimping of the conductor crimping section 54 forces the outer conductor 16 into contact with the conductor crimping section 50 and/or the lip 56 to provide high pressure electrical contact therebetween.

The inner conductor body 32 is attached to the inner conductor 12 of the cable 10 via the dowel 70. More specifically, the diameter of the dowel 70 is slightly greater than the diameter of the bore 12*a* of the inner conductor 12. The dowel 70 is passed through the bore 40 of the inner conductor body 32 (starting at the flared tip 47), then driven into the bore 12*a* (typically at high speed and/or under high pressure). Because the dowel 70 is larger than the bore 12*a*, it forces the bore 12*a* radially outwardly to form a high pressure interference fit with the inner surface of the boss 42 that attaches the inner conductor 12 to the inner conductor body 32 and establishes electrical contact therewith.

Those skilled in this art will appreciate that the dowel 70 may be replaced with another variety of expansion member that causes the inner conductor 12 to expand radially outwardly sufficiently to form a joint with the boss 42 of the inner conductor body 32. It should also be noted that, although the boss 42 is shown as a continuous annulus, it may be discontinuous; for example, it may include one or more slots to encourage radial expansion. Also, the dowel or other expansion member may have a smooth surface, or it may have a textured or roughened surface. For example, the dowel's outer surface may be completely or partially knurled (e.g., both ends may be knurled with a smooth central portion, or both ends may be smooth with a knurled central portion, one end may be smooth and the other knurled, etc.). Moreover, the dowel may be partially or completely hollow, which may effectively "soften" the dowel, thereby providing a preselected balance of joint strength and stress on the bore of the inner conductor of the cable. Further, in some embodiments, the dowel 12 or other expansion member may be combined into a single component with the inner conductor body 32 rather than being a separate and distinct component. Finally, the dowel or other expansion member may be used to connect other types of conductors, such as power conductors.

It can thus be seen that connectors according to embodiments of this invention can provide three interfaces within the same assembly where the clamping force is provided by deflection/distortion of one of the members of the mating interface. By using high pressure interfaces rather than soldering, PIM can be reduced significantly.

Those of skill in this art will appreciate that, although the plug 30 is illustrated herein, a jack or other connector may be suitable for use with the concepts discussed above. Also, although a galvanic connection is anticipated between the plug 30 and a mating jack, the concepts may be employed with connectors designed for capacitive coupling (see, e.g., U.S. patent application Ser. No. 14/303,745, filed Jun. 13, 2014, the disclosure of which is hereby incorporated herein in its entirety). It should also be noted that any one of the three crimping operations may be employed independently, with the joining of the other two interfaces being achieved by other means.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable-connector assembly, comprising:

(a) a coaxial cable comprising:

an inner conductor having a termination end, the termination end including a bore;

a dielectric layer that overlies the inner conductor;

an outer conductor that overlies the dielectric layer having a termination end; and a jacket that overlies the outer conductor; and (b) a coaxial connector comprising:

an inner conductor body configured to mate with the inner conductor body of a mating coaxial cable jack, the inner conductor body including a boss that encircles the termination end of the inner conductor, and further including a longitudinal bore;

an outer conductor body configured to mate with the outer conductor body of the mating coaxial cable jack, the outer conductor body being electrically connected with the termination end of the outer conductor; and an expansion member inserted into the bore of the termination end of the inner conductor, the expansion member being sized and configured to radially expand the termination end of the inner conductor into electrical contact with the boss of the inner conductor body.

2. The assembly defined in claim 1, wherein the expansion member extends into the bore of the inner conductor body.

3. The assembly defined in claim 1, wherein the outer conductor body includes a radially inward lip, such that a gap is formed between the lip and an inner surface of the outer conductor body, and wherein the termination end of the outer conductor of the cable resides within the gap.

4. The assembly defined in claim 3, wherein the outer conductor body is crimped onto the termination end of the outer conductor.

5. The assembly defined in claim 3, wherein the lip serves as a stop for the outer conductor.

6. The assembly defined in claim 1, further comprising a resilient sleeve interposed between the jacket and the outer conductor body.

7. The assembly defined in claim 6, wherein the outer conductor body is crimped onto the resilient sleeve.

8. The assembly defined in claim 4, further comprising a resilient sleeve interposed between the jacket, wherein the outer conductor body is crimped onto the resilient sleeve.

9. A method of forming a coaxial cable-connector assembly, comprising the steps of:

(a) providing a coaxial cable comprising:

an inner conductor having a termination end, the termination end including a bore;

a dielectric layer that overlies the inner conductor; and an outer conductor that overlies the dielectric layer having a termination end;

(b) providing a coaxial connector comprising:

an inner conductor body configured to mate with the inner conductor body of a mating coaxial cable jack, the inner conductor body including a boss that encircles the termination end of the inner conductor, and further including a longitudinal bore; and an outer conductor body configured to mate with the outer conductor body of the mating coaxial cable jack, the outer conductor body being electrically connected with the termination end of the outer conductor;

(c) inserting an expansion member into the bore of the termination end of the inner conductor, the expansion member being sized and configured to radially expand the termination end of the inner conductor into electrical contact with the boss of the inner conductor body.

10. A cable-connector assembly, comprising:

(a) a cable comprising a conductor having a termination end, the termination end including bore;

(b) a connector comprising a conductor body configured to mate with a conductor body of a mating connector; and (c) an expansion member inserted into the bore of the termination end of the conductor, the expansion member being sized and configured to radially expand the termination end of the conductor into electrical contact with the conductor body.

11. The assembly defined in claim 10, wherein the expansion member is a separate and distinct component from the conductor body.

12. The assembly defined in claim 11, wherein the conductor body includes a bore, and wherein the expansion member is inserted into the bore of the conductor body.

* * * * *